US007862310B2

(12) United States Patent
Deichmann et al.

(10) Patent No.: US 7,862,310 B2
(45) Date of Patent: Jan. 4, 2011

(54) FUEL PUMP

(75) Inventors: Johannes Deichmann, Alheim-Starkelshausen (DE); Eberhard Geissel, Künzell (DE); Sven Kretschmar, Wetter (DE); Zlatko Penzar, Frankfurt am Main (DE)

(73) Assignee: Siemens Aktiengesellschaft, München (DE)

( * ) Notice: Subject to any disclaimer, the term of this patent is extended or adjusted under 35 U.S.C. 154(b) by 999 days.

(21) Appl. No.: 10/571,211

(22) PCT Filed: Aug. 2, 2004

(86) PCT No.: PCT/EP2004/051686

§ 371 (c)(1),
(2), (4) Date: Nov. 21, 2006

(87) PCT Pub. No.: WO2005/026523

PCT Pub. Date: Mar. 24, 2005

(65) Prior Publication Data

US 2007/0065313 A1 Mar. 22, 2007

(30) Foreign Application Priority Data

Sep. 11, 2003 (DE) ..... 103 42 256

(51) Int. Cl.
*F01D 25/26* (2006.01)
*F28F 7/00* (2006.01)

(52) U.S. Cl. ..... 417/423.14; 415/134; 415/135

(58) Field of Classification Search ..... 417/423.14; 415/134, 135

See application file for complete search history.

(56) References Cited

U.S. PATENT DOCUMENTS

| | | | | |
|---|---|---|---|---|
| 5,265,997 | A | 11/1993 | Tuckey | |
| 5,702,229 | A | 12/1997 | Moss et al. | |
| 6,019,570 | A | 2/2000 | Talaski | |
| 6,227,819 | B1 | 5/2001 | Gettel et al. | |
| 6,231,318 | B1 | 5/2001 | Cotton et al. | |
| 6,270,310 | B1 | 8/2001 | Gaston et al. | |
| 6,454,521 | B1 | 9/2002 | Anderson et al. | |
| 2003/0185693 | A1 * | 10/2003 | Iwanari | 417/423.7 |

FOREIGN PATENT DOCUMENTS

| | | | |
|---|---|---|---|
| DE | 31 18 533 | A1 | 12/1982 |
| DE | 31 30 288 | A1 | 2/1983 |
| DE | 34 24 520 | A1 | 1/1986 |

(Continued)

OTHER PUBLICATIONS

German language translation of Chinese Office Action dated Nov. 30, 2007 issued in corresponding Chinese application No. 200480026101.0.

*Primary Examiner*—Charles G Freay
(74) *Attorney, Agent, or Firm*—Cohen Pontani Lieberman & Pavane LLP

(57) ABSTRACT

The invention relates to a pump module (2) comprising a housing part (4) with precisely determined force introduction points (25) in relation to adjacent components. Supporting elements (24, 27) and a groove (26) are located between the force introduction points (25) and a disc element (20) that comprises a partially annular channel (10). Forces that are introduced into the housing parts (4) thus lead to negligible deformations in the areas of said housing parts (4) that are adjacent to the impeller.

12 Claims, 2 Drawing Sheets

FOREIGN PATENT DOCUMENTS

| | | | |
|---|---|---|---|
| DE | 42 40 542 | A1 | 7/1993 |
| DE | 197 44 753 | A1 | 4/1998 |
| DE | 199 00 142 | A1 | 7/1999 |
| DE | 101 11 990 | | 10/2001 |
| DE | 101 11 990 | A1 | 10/2001 |
| JP | 6-317285 | | 11/1994 |
| JP | 11-257269 | | 9/1999 |
| JP | 2001-115918 | | 4/2001 |
| JP | 2001-289190 | | 10/2001 |

* cited by examiner

FUEL PUMP

BACKGROUND OF THE INVENTION

The invention relates to a fuel pump with a pump stage driven by an electric motor, with a jacket surrounding the electric motor and the pump stage and having an impeller arranged rotatably between two casing parts of the pump stage, with an inlet duct arranged in one of the casing parts and an outlet duct arranged in the opposite casing part, with rings, arranged in the impeller, of guide blades delimiting blade chambers, and with part-annular ducts arranged in the casing parts and located opposite the rings of the guide blades, the part-annular duct of the inlet-side casing part being connected to the inlet duct and the part-annular duct of the outlet-side casing part being connected to the outlet duct.

Such fuel pumps are often used for the conveyance of fuel out of a fuel tank to an internal combustion engine in present-day motor vehicles and are known from practice. The casing parts of the known pump stages are manufactured mostly from metal or sintered ceramic, in order to achieve an intended stability. For example, as a result of holding forces of the jacket or owing to temperature fluctuations, forces are introduced into the pump stage, which lead to a flexion of the casing parts. Furthermore, a return body is supported over the entire circumference on one of the casing parts of the pump stage and is braced radially with respect to the casing part. Both axial and radial forces are therefore introduced into the casing part, thus likewise leading to a flexion of the casing part. However, a flexion of the casing parts leads to a variation in an axial gap between the casing parts and the impeller. Moreover, a pressure generated by the pump stage in the electric motor leads to a reduction in the axial gap between the casing part arranged nearest to the electric motor and the impeller.

The known fuel pump has the disadvantage that it is highly cost-intensive to produce because the casing parts of the pump stage are manufactured from metal or sintered ceramic.

The problem on which the invention is based is to design a fuel pump of the type initially mentioned, in such a way that it can be produced particularly cost-effectively and a flexion of the casing parts of the pump stage is largely avoided.

BRIEF DESCRIPTION OF THE INVENTION

This problem is solved, according to the invention, in that the casing parts have a disk element with one of the part-annular ducts, and in that they have, on the outer circumference of the disk element, connecting elements with force introduction surfaces for connection to adjoining components of the jacket or of the electric motor, and in that the connecting elements are arranged in the region of the neutral fiber in terms of the buckling of the casing parts, or in that supporting elements are provided which are designed for the reversal of forces introduced into the casing parts at the force introduction points and consequently for the generation of counter-forces corresponding to the introduced forces.

By virtue of this configuration, a lever arm between the force introduction points and the radially inner region of the casing parts which is formed by the disk element is avoided. The connecting elements lead to an exactly determinable point at which the forces are introduced into the casing parts. Forces introduced from adjoining components into the casing parts therefore no longer lead to a flexion of the casing parts in their regions adjoining the impeller.

Owing to the invention, the casing parts can be manufactured from particularly cost-effective materials.

According to an advantageous development of the invention, the introduction of the forces into the neutral fiber in terms of buckling requires a particularly low structural outlay when the connecting elements have a rim arranged on the outer circumference of the disk element.

According to another advantageous development of the invention, a flexion of the inlet-side casing part by radial forces introduced into the pump stage through the jacket can be avoided in a simple way when the rim is arranged at half the height of the disk element of the inlet-side casing part having essentially a uniform thickness.

According to another advantageous development of the invention, a flexion of the outlet-side casing part as a result of axial forces of adjoining components can be avoided in a simple way when the rim is arranged vertically on the outer circumference of the disk element of the outlet-side casing part and has a collar projecting radially outward, and when the force introduction points for axially introduced forces are arranged on the collar.

According to another advantageous development of the invention, the connection of the regions of the outlet-side casing part which are located opposite the impeller to the force introduction points can transmit only very low forces when the outlet-side casing part has a groove between the rim and the radially inner region of the disk element.

According to another advantageous development of the invention, the outlet-side casing part has particularly high stability when radially inner supporting elements interrupt the groove and connect the disk element to the rim.

The rim of the outlet-side casing part can flex during the introduction of axial forces, without forces being introduced into that region of the disk element which is located opposite the impeller, when the rim is spaced apart from the radially outer boundary of the outlet-side casing part.

According to another advantageous development of the invention, a contribution is made to a further reduction in the moments of flexion introduced into the disk element when radially outer supporting elements are arranged, offset with respect to the radially inner supporting elements, on the radially outer side of the rim.

In the case of forces introduced axially into the outlet-side casing part, the rim can undergo deformation virtually independently of the disk element when the force introduction points for axially introduced forces are arranged on the radially outer supporting elements. This contributes to a further reduction in the moments of flexion introduced into the disk element.

According to another advantageous development of the invention, an introduction of radial forces into the outlet-side casing part over the entire circumference can be avoided in a simple way when individual force introduction points for radially introduced forces are arranged on the rim.

According to another advantageous development of the invention, a thermal deformation of the disk element of the outlet-side casing part due to waste heat from the electric motor can be avoided in a simple way when the outlet-side casing part has an annular recess between the part-annular duct and a mounting of the shaft.

The fuel pump according to the invention can be manufactured particularly cost-effectively when at least one of the casing parts is manufactured from plastic.

BRIEF DESCRIPTION OF THE DRAWINGS

The invention permits numerous embodiments. To make its basic principle even clearer, one of these is illustrated in the drawing and is described below. In the drawing.

DETAILED DESCRIPTION OF THE INVENTION

Figure 1:
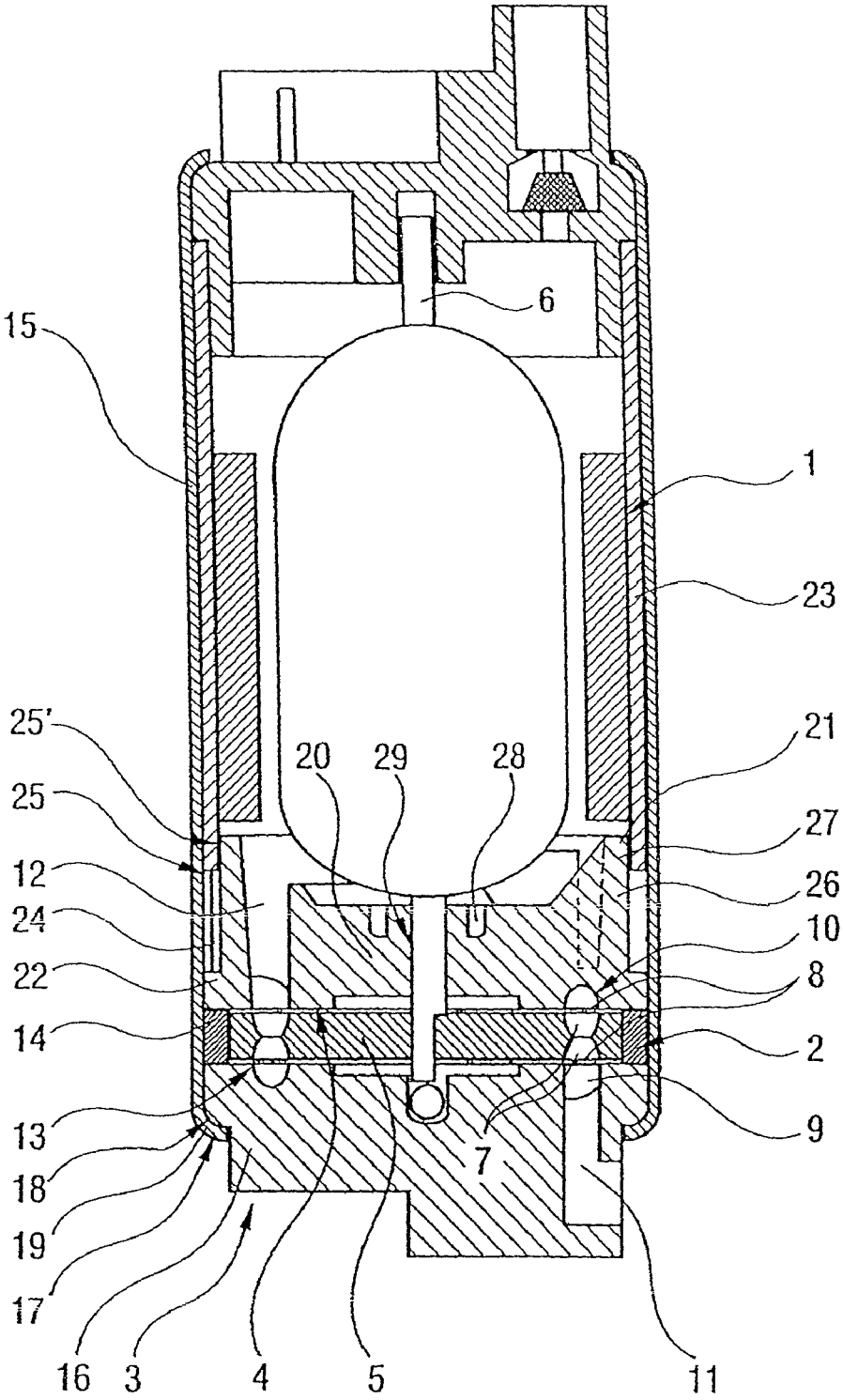
FIG. 1 shows a longitudinal section through a fuel pump according to the invention.

FIG. 1 shows a longitudinal section through a fuel pump with a pump stage 2 driven by an electric motor 1 and designed as a side channel pump. The pump stage 2 has an impeller arranged rotatably between two casing parts 3, 4. The impeller 5 is arranged fixedly in terms of rotation on a shaft 6 of the electric motor 1 and has two rings, located opposite one another, of guide blades 8 delimiting blade chambers 7. Part-annular ducts 9, 10 are arranged in each case, opposite the rings of the guide blades 8, in the casing parts 3, 4. The part-annular ducts 9, 10 form with the blade chambers 7 a conveying chamber 13 leading from an inlet duct 11 to an outlet duct 12. The inlet duct 11 and the outlet duct 12 are arranged on casing parts 3, 4 located opposite one another. The casing parts 3, 4 are spaced apart by means of a ring 14. Furthermore, the fuel pump has a jacket 15 made from sheet metal.

The jacket 15 is flanged at its ends and prestresses the components of the fuel pump with respect to one another. The inlet-side casing part 3 consists essentially of a planar disk element 16 and of a rim 17 arranged at half the height of its circumference. The rim 17 is consequently arranged level with the neutral fiber in terms of the buckling of the inlet-side casing part 3 and forms a force introduction point 18 for the jacket 15. A flanging 19 of the jacket 15 engages behind the rim 17. Radial forces introduced from the flanging 19 into the rim 17 consequently do not lead to a flexion of the inlet-side casing part 3.

Figure 2:
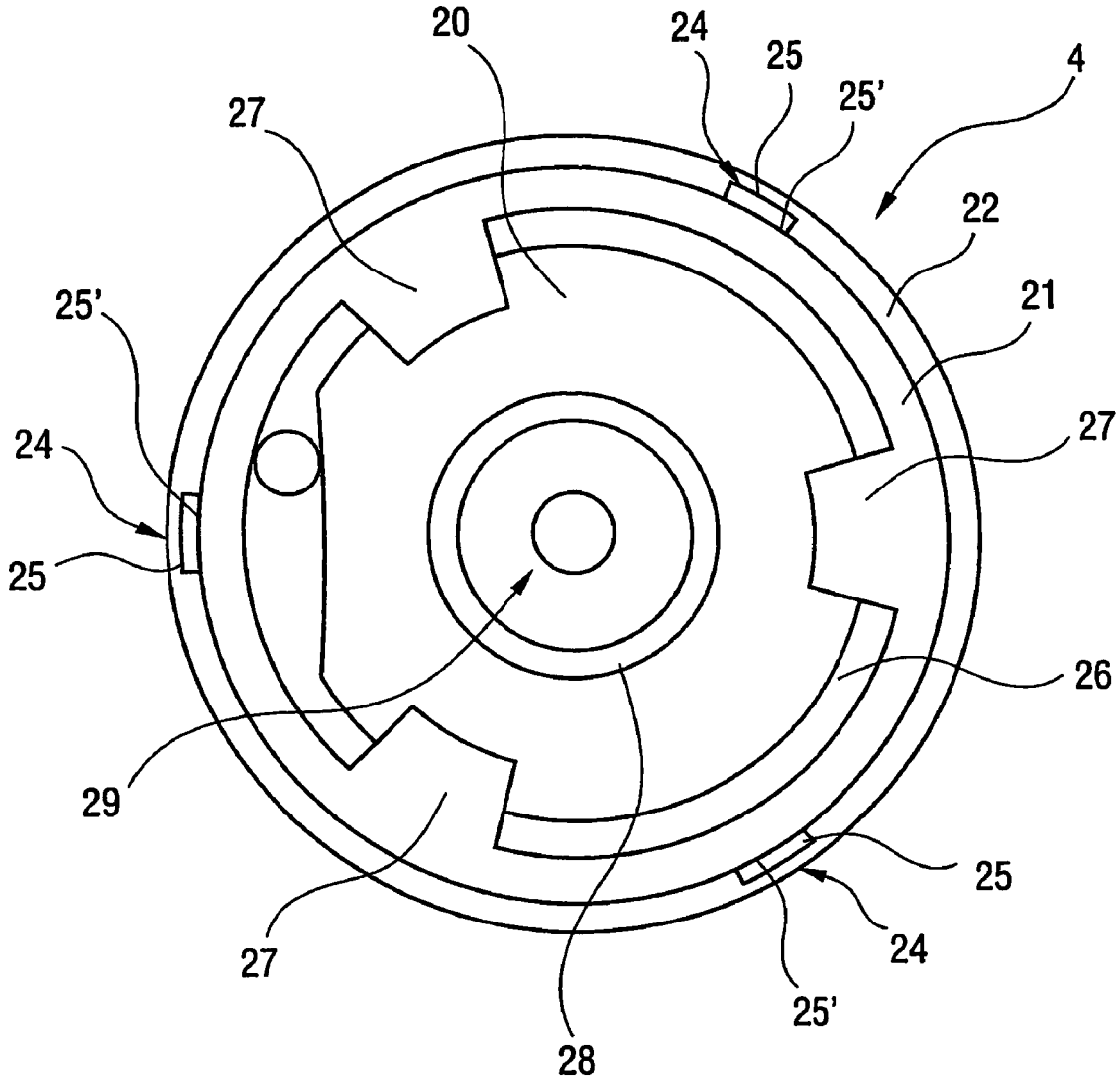
FIG. 2 shows a top view of an outlet-side casing part of the fuel pump from FIG. 1.

The outlet-side casing part 4 has a disk element 20 located opposite the impeller 5 and, near its outer circumference, a rim 21 arranged perpendicularly with respect to the disk element 20 and in FIG. 2 is illustrated in a top view from the side of the electric motor 1 of FIG. 1. A collar 22 running around radially outside the rim 21 is led as far as the jacket 15. A return ring 23 of the electric motor 1 is supported axially on radially outer supporting elements 24 of the pump stage 2 which are arranged on the collar 22. Force introduction points 25 for forces introduced axially into the outlet-side casing part 4 are consequently arranged on the radially outer supporting elements 24. Force introduction points 25' for forces introduced radially into the outlet-side casing part 4 are arranged on the rim near to the radially outer supporting elements 24 only. The outlet-side casing part 4 has, as seen radially on the inside from the rim 21, a groove 26 which is interrupted by radially inner supporting elements 27 connecting the rim 21 to the disk element 20. The radially inner supporting elements 27 are arranged so as to be offset with respect to the radially outer supporting elements 24. Axial forces from the return ring 23 of the electric motor 1 are introduced into the outlet-side casing part 4 via the radially outer supporting elements 24 and may lead to a deformation of the rim 21. A transmission of the forces to the disk element 20 is avoided by the arrangement of the radially inner and outer supporting elements 24, 27 and the groove 26 in relation to one another. When the return ring 23 of the electric motor 1 exerts a radial prestress on the outlet-side casing part, the forces can be introduced only at the force introduction points 25' for the radial forces. Owing to the offset of the radially inner supporting elements 27 having the force introduction points 25' for the radial forces, a countermoment is generated at the disk element 20 and prevents the flexion of the latter.

The outlet-side casing part 3 has an annular recess 28 in its radially inner region, as seen from the part-annular duct 10. This annular recess 28 decouples that region of the outlet-side casing part 4 which is located opposite the shaft 6 of the electric motor 1 from the region having the part-annular duct 10. Moreover, the outlet-side casing part 4 has a mounting 29 for the shaft 6 of the electric motor 1.

In an alternative embodiment, not illustrated, the return ring 23 of the electric motor 1 may also have individual supporting elements, by means of which it is supported between the radially inner supporting elements 27 of the outlet-side casing part 4. In this case, the force introduction points would be arranged directly on the collar 22 running around.

The invention claimed is:

1. A fuel pump having a pump stage driven by an electric motor, comprising:

a jacket surrounding the electric motor and the pump stage;

an impeller arranged rotatably between two casing parts of the pump stage, an inlet duct being arranged in an inlet-side casing part of the casing parts and an outlet duct being arranged in an outlet-side casing part of the casing parts, rings of guide blades being arranged in the impeller and delimiting blade chambers, and part-annular ducts being arranged in the two casing parts and located opposite the rings of the guide blades, a part-annular duct of the inlet-side casing part being connected to the inlet duct and a part-annular duct of the outlet-side casing part being connected to the outlet duct;

wherein each of the two casing parts includes a disk element and one of the part-annular ducts and includes, on an outer circumference of the disk element, connecting elements having force introduction surfaces for connection to one of adjoining components of the jacket and the electric motor; and wherein the connecting elements are arranged in a region of the two casing parts at which buckling of the two casing parts occurs, and supporting elements are provided which are configured to reverse forces introduced into the outlet-side casing part at the force introduction surfaces and generate counterforces corresponding to the forces introduced into the outlet-side casing part.

2. The fuel pump as claimed in claim 1, wherein the connecting elements comprise a rim arranged on the outer circumference of each disk element.

3. The fuel pump as claimed in claim 2, wherein on the inlet-side casing part the rim is arranged at a height of half the disk element, the inlet-side casing part having an essentially uniform thickness.

4. The fuel pump as defined in claim 2, wherein on the outlet-side casing part the rim is arranged vertically on the outer circumference of the disk element and includes a collar projecting radially outward, and wherein force introduction surfaces for axially introduced forces are arranged on the collar.

5. The fuel pump as defined in claim 4, wherein the outlet-side casing part includes a groove between the rim and a radially inner region of the disk element.

6. The fuel pump as defined in claim 5, further comprising:

radially inner supporting elements which interrupt the groove and connect the disk element to the rim.

7. The fuel pump as defined in claim 4, wherein the rim is spaced apart from a radially outer boundary of the outlet-side casing part.

8. The fuel pump as defined in claim 6, further comprising: radially outer supporting elements arranged, offset with respect to the radially inner supporting elements, on a radially outer side of the rim.

9. The fuel pump as defined in claim 8, wherein the force introduction points for the axially introduced forces are arranged on the radially outer supporting elements.

10. The fuel pump as defined in claim 4, wherein individual force introduction points for radially introduced forces are arranged on the rim.

11. The fuel pump as defined in claim 1, wherein the outlet-side casing part includes an annular recess between one of the part-annular ducts and a mounting point of the shaft.

12. The fuel pump as defined in claim 1, wherein at least one of the two casing parts is manufactured from plastic.

* * * * *